US009480886B2

(12) United States Patent
Sridhar

(10) Patent No.: US 9,480,886 B2
(45) Date of Patent: Nov. 1, 2016

(54) GOLF PUTTER SUITABLE FOR VERY EFFECTIVE SINGLE-HANDED PUTTING

(76) Inventor: Sanjay Sridhar, Bangalore (IN)

( * ) Notice: Subject to any disclaimer, the term of this patent is extended or adjusted under 35 U.S.C. 154(b) by 0 days.

(21) Appl. No.: 13/991,622

(22) PCT Filed: May 2, 2011

(86) PCT No.: PCT/IN2011/000304

§ 371 (c)(1),
(2), (4) Date: Jun. 4, 2013

(87) PCT Pub. No.: WO2012/101650

PCT Pub. Date: Aug. 2, 2012

(65) Prior Publication Data

US 2013/0296066 A1 Nov. 7, 2013

(30) Foreign Application Priority Data

Jan. 27, 2011 (IN) ..... 256/CHE/2011

(51) Int. Cl.

| | |
|---|---|
| ***A63B 53/02*** | (2015.01) |
| ***A63B 53/00*** | (2015.01) |
| ***A63B 53/14*** | (2015.01) |
| ***A63B 53/04*** | (2015.01) |

(52) U.S. Cl.

CPC ..... *A63B 53/007* (2013.01); *A63B 53/0487* (2013.01); *A63B 53/14* (2013.01); *A63B 53/02* (2013.01); *A63B 60/08* (2015.10); *A63B 60/10* (2015.10); *A63B 60/12* (2015.10); *A63B 2053/022* (2013.01); *A63B 2060/0081* (2015.10)

(58) Field of Classification Search

CPC ..... A63B 53/007; A63B 2053/02; A63B 2053/022

USPC ..... 473/293, 300, 409, 340

See application file for complete search history.

(56) References Cited

U.S. PATENT DOCUMENTS

| | | | | |
|---|---|---|---|---|
| 4,605,228 | A * | 8/1986 | Guendling, Jr. | 473/409 |
| 5,190,291 | A * | 3/1993 | Melvin | 473/232 |
| 6,039,657 | A * | 3/2000 | Gidney | 473/252 |
| 6,152,832 | A * | 11/2000 | Chandler, III | 473/293 |
| 6,688,989 | B2 * | 2/2004 | Best | 473/332 |
| 2007/0032311 | A1 * | 2/2007 | Kajita | A63B 53/0487 473/340 |
| 2008/0009362 | A1 * | 1/2008 | Burns, Jr. | 473/293 |

* cited by examiner

*Primary Examiner* — Benjamin Layno

(57) ABSTRACT

In view of the foregoing, an embodiment herein provides an improved putter which is especially suited for single handed putting. Accordingly, the golf putter includes a putter head, a shaft and a grip, wherein hitting surface of the putter head and flat surface of the grip are parallel and facing the hole while executing the putting stroke. The golf putter can also be used in a conventional manner by holding it with both hands. The line of vision of the golfer is not distorted while employing the instant putting technique and the new putting technique gives excellent directional control to the golfer.

8 Claims, 4 Drawing Sheets

A
F
F
p
q
E
E
4
D
D
s
r
C
C
1
y
x
4
1
B
B
3
a
b
c
d
e
l
m
2
2
A (PLAN F-F)

(SECTION E-E)

(SECTION D-D)

(SECTION C-C)

(SECTION B-B)

(SECTION A-A)

GOLF PUTTER SUITABLE FOR VERY EFFECTIVE SINGLE-HANDED PUTTING

FIELD OF INVENTION

The embodiments herein generally relate to a golf putter and, more particularly, relate to an improved putter and method of putting using the said putter.

BACKGROUND AND PRIOR ART

Golf is an outdoor sport played on a green course with golf holes, each of which have a starting and an ending point. Whoever can put the ball into the cup of each hole in the least amount of strokes, and thereby get the lowest scores, wins. A typical golf course has eighteen holes where par (number of strokes a golfer is expecteduy to need to complete all the holes) is 72 strokes. The golfer is allowed to use a maximum of 14 golf clubs typically consisting of Irons, Woods and a Putter . . . .Out of these 14 clubs, the putter is the most frequently used club and also the most important. In a typical round of golf, the putter is used as many as about 28 to 36 time. Therefore, to be able to putt well is an advantage to achieving a low score.

Although the distance to be covered in putting is far less than that covered by the other clubs, putting also requires a great deal accuracy in order to execute the putt successfully. Therefore, to facilitate putting, many a different kinds of putters have been invented.

Putters generally come in three different types of club heads (traditional blade, a heel-toe or a mallet) and three different lengths (standard, belly putters and long putters).

It has been found that the more easily the body joints of the golfer can be bent or twisted, the more degrees of freedom the golfer has while putting. It might give more flexibility but can result in inconsistent putts. A common error seen during putting is that the golfer may wrongly bend his wrists which will result in loss of direction and this is called "yips" (uncontrollable motions).

Most standard putters have a 32"-35" long shaft, which gives six degrees of freedom to the golfer: hands, wrists, elbows, shoulders, waist and knees. A belly putter is usually 6-8 inches longer than a normal putter and is placed against the stomach. The conventional putter requires proper co-ordination between hands, wrists, elbows, and shoulders. The long putter is longer than the belly putter and is placed against the chin or chest and reduces the importance of the hands, wrists, elbows and shoulders. The putt is better controlled with the long putter but the use of it in professional tournament is currently debated on.

While putting with a standard putter conventionally the golfer grips the top of the shaft of his putter and swings it along a line that will create the pendulum movement which causes the ball to move into the hole. In another method of putting, he grips the shaft with one hand and grips the arm with the other hand. But in both these methods, the muscles of the wrists and hands are used to execute the pendulum movement; non-coordination of these muscles can result in "yips"

Again, while putting with a putter longer than the standard putter, since the design reduces the importance of hands, wrists, elbows and shoulders, it consequently results in lesser control over putting power and feel. The long putter is gripped with one hand at the top of the shaft and the other at the middle. The putter is held in a vertical position, the club head being perpendicular to the ground and aligned to the ball. The putter is then swung along a predetermined line to achieve a pendulum swing and cause the ball to fall into the hole. Again, the demerit of using the known technique of putting is that the muscles of the wrists and hands are at play and it result in less control over the putter and there is a possibility of involuntary movements (yips).

Therefore, both methods of putting, using a standard putter or a longer putter, have the disadvantage of employing the wrists and hands resulting in inaccuracy and inconsistent putting performance.

There have been several techniques discussed in golf to hold the wrists steady during putting, so that they don't succumb to involuntary movements. Modified gripping had been designed where the bottom of the grip is held with the left hand, and the right hand is separated from the left hand and holds the shaft against the left forearm. But in the modified way of gripping, the golfer has to bend over more than he does while using a standard putter. The golfers often complain of a lack of "feel" when using above technique.

The above techniques relate to the traditional and modified techniques of gripping to steady the involuntary movements of the wrists and hands while putting. When it comes to the methods of putting, there are two general methods of putting. In the traditional method of putting, the player grips the putter with both the hands, takes a stance in such a way that the imaginary line passing through the two toes is perpendicular to the line of putt whereas with the new putter the player grips the putter with one hand only and facing the hole, takes a stance in such a way that the imaginary line passing through the toes is perpendicular to the line of putt.

In employing the traditional method of putting, there appears to be three major disadvantages:

First, the method involves two hands and it requires a great amount of training to coordinate the muscles of two hands perfectly because a minor muscle in-coordination can result in a missed putt.

Second, the putter head normally swings in an arc around the putter's spine. Therefore, to make the ball travel in a straight line, the ball must be struck at a precise point in that arc which can make it travel in the intended straight line. To overcome this problem, many players prevent spine rotation and achieve the pendulum swing with the movements of and shoulders only Third, and the biggest problem, the golfer cannot see the hole during the stroke. He looks at the hole, memorizes its position, and then focuses his attention to the putter-head and the ball. Also, since the golfer is positioned perpendicular to the intended line, his head is turned sideways while looking at the hole. In the sideway glance, one eye is above the other eye, hence his vision is contorted as he perceives the target to be further right than it actually is.

In employing the second method of putting while facing the hole, there are prior arts that have been successful in complying with the golf rules and constructing a putter. The prior art patents are U.S. Pat. Nos. 4,240,636, 4,163,554, 3,679,207 and 6,152,832. Out of these four patents, the first three employs both hands on the putter while facing the hole. These patents could not eliminate the disadvantages of the traditional method. The fourth patent, US'832, by Chandler, was a one-handed method which successfully solved the arc-travel problem of the prior patents. But there were alignment difficulties experienced while using Chandler's putter because the putter face is directly below the golfer's shoulder.

Therefore, there exists a need to have a putter that eliminates the difficulties faced by the existing putting methods and makes it easier for the golfer to make alignment assessments, and improves putting by eliminating the errors involved.

OBJECTS OF THE INVENTION

One object of the invention is to provide a new, improved putter that gives consistent and accurate putting performance.

Another object of the invention is to provide a putter than can be used both in the traditional two-hand method of putting and in the single-hand method of putting.

Yet another object of the invention is to provide a putting technique that involves very few muscles and hence, reduces putting errors that occurs due to muscle non-coordination.

Yet another object of the invention is to provide a putting method in which the line of vision of the golfer is not contorted.

Yet another object of the putter is to solve the arc-travel problem that is commonly associated when employing the traditional method.

SUMMARY OF THE INVENTION

In view of the foregoing, an embodiment herein provides an improved putter which is especially suited for single handed putting i.e., holding the putter with one hand during the execution of the putting stroke.

According to an embodiment of present invention, the golf putter comprises a grip, a putter-head, a shaft and a neck, wherein the hitting surface of the putter head and the flat surface of the grip are parallel and facing the hole while executing the putting stroke. In an embodiment, the length of the shaft is made to suit the height of the golfer. Similarly, the length of the grip can also be made to suit the length of the arm of the golfer. The taller the golfer, the longer can be the shaft or grip.

According to an embodiment of present invention, very few muscles are involved in making the putting stroke and therefore coordination between the muscles is easy and less prone to errors.

In an embodiment, the golfer faces the target, and a pendulum swing is easily achievable with the new putter by holding it with one hand and facing the hole. The new putter can also be used in a conventional manner by holding it with both hands.

In an embodiment, the grip can have more than one flat surface. In another embodiment, the putter shaft is made highly flexible so that the ball can be hit with a whipping action. In yet another embodiment, the striking surface and the rear surface of the putter head are both flat.

In one embodiment, the shaft is connected to the putter head with a neck piece. In another embodiment, the shaft is connected directly to the putter head without a neck piece. In yet another embodiment, the shaft of the putter is connected to the putter head using a bent neck.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF DRAWINGS

The embodiments herein will be better understood from the following description with reference to the drawings, in which.

DETAILED DESCRIPTION OF EMBODIMENTS

Figures 1, 2, 3, 4, 5, 6, 7:
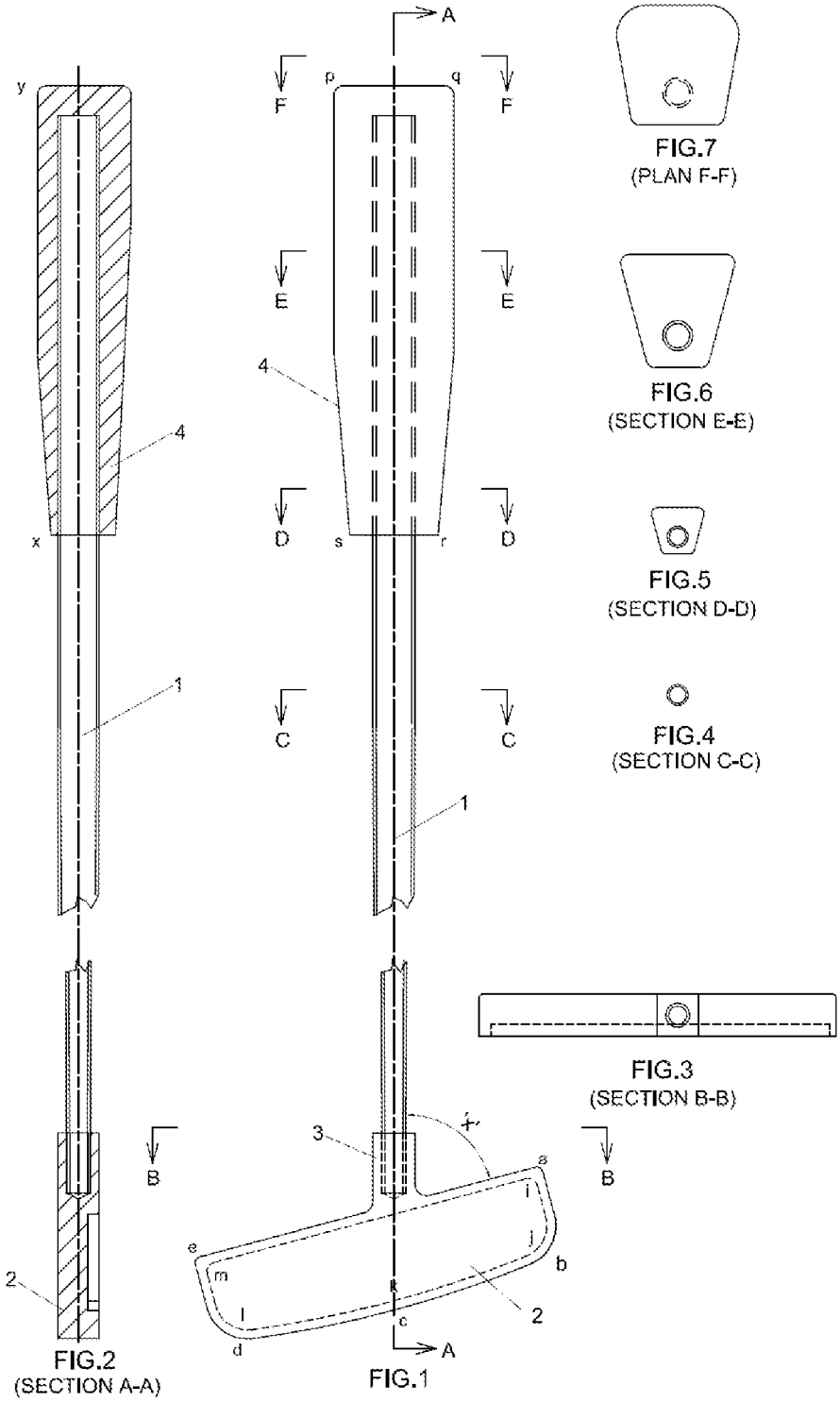
FIG. 1—illustrates the front elevation of the putter when it is resting on the ground with the center line of the shaft being vertical, according to an embodiment herein.
FIG. 2—depicts section A-A of FIG. 1, according to an embodiment herein.
FIG. 3—depicts section B-B of FIG. 1, according to an embodiment herein.
FIG. 4—depicts the cross section C-C of FIG. 1, according to an embodiment herein.
FIG. 5—depicts cross section D-D of FIG. 1, according to an embodiment herein.
FIG. 6—depicts section E-E of FIG. 1, according to an embodiment herein.
FIG. 7—depicts view F-F of FIG. 1, according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there remains a need for a putter, especially suitable for single handed putting, that can facilitate successful putting without too many errors. The embodiments herein achieve by providing a golf putter especially suited for single-handed putting, wherein very few muscles are involved in the exercise of putting and hence, is less prone to errors. Referring now to the drawings, and more particularly to FIGS. 1 through 13, where similar reference characters denote corresponding features consistently throughout the figures, there are shown preferred embodiments.

FIG. 1 illustrates the front view of the Golf Putter and FIG. 2 shows the corresponding side view of the same. FIG.

3 shows the cross sectional view of the area of the putter-head marked B, B in FIG. 1. The various parts of the Golf Putter, comprising a Hollow Tapered Shaft (1), a Head (2), a Neck (3) and a Grip (4) are illustrated in FIG. 1.

The Head (2) has a flat striking face defined by points a, b, c, d & e in FIG. 1). The head has a neck (3) with a hole and the lower end of shaft (1) is fitted in the hole and secured. The rear face of the putter has a depression to reduce the weight of the putter head. The depressed surface is depicted by boundary points: i, j, k, l & m. The acute angle 'X" between the center line of shaft (1) and the line joining points 'a' and 'b' on the striking face of the putter is not more than 75 degrees. The putter head (2) has a curved bottom with a radius of not less than 254 millimeters as depicted in FIG. 1.

In an embodiment, the thickness of the putter head (2) and the depth of depression are determined based on the required weight of the putter head. There can be very heavy weight heads or light weight heads depending on the player's choice. Likewise the length of the putter shaft (1) and the width of the putter head (2) are also a matter of choice for the player. However the player should not make changes in putter construction during a game as per USGA rules. Several models can be manufactured to suit different requirement of players.

In an embodiment, as illustrated in FIG. 1, the putter head (2) has a neck (3) for joining to the shaft (1) and can be manufactured integrally with the putter head (2). Suitable glue can be used to attach the shaft end to the neck. Heat and cool shrunk fit connection can also be done for securing the shaft to putter head.

Figure 13:
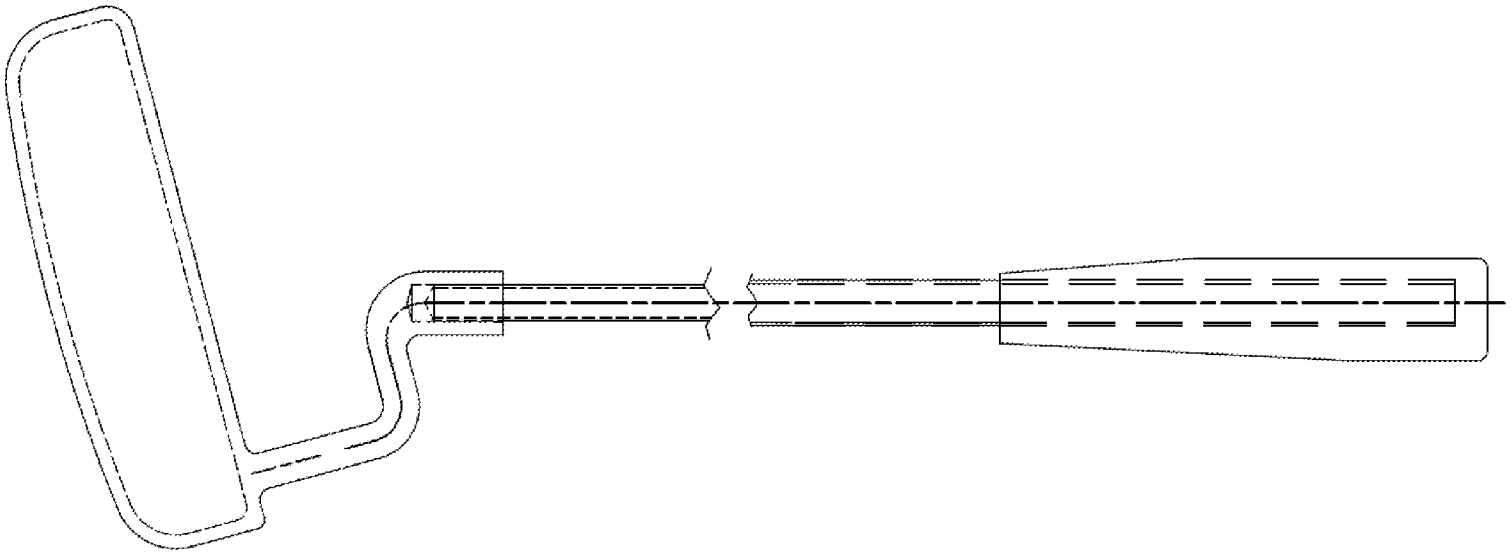
FIG. 13 depicts a putter wherein the shaft is connected to the head through a bent neck, according to an embodiment herein.

There are two other ways of constructing the putter-head as shown in FIGS. 13 and 14. In one embodiment, the shaft (1) can also be attached to the putter head (2) without a neck as shown in FIG. 13. In the other embodiment, the shaft can be attached to a putter with a bent neck as illustrated in FIG. 14.

The putter head (1) along with Neck (3) in the various embodiments can be made of steel, non-ferrous metals, ceramics or glass.

As shown in FIG. 1, one of the constituents of the putter is the grip (4). The grip has a flat surface bound by points: p, q, r & s. Also, the line joining points 'p' and 'q' is parallel to the plane passing through the flat striking surface of the putter head. Thus, when the putter head is facing the ball, the flat surface of the grip is also facing in the same direction. It is an important feature of the invention as it helps the golfer to stabilize the putter during the strike.

In another embodiment of the grip, the grip has more than one flat surface.

The dimensions of the grip along the length of the shaft are illustrated in FIGS. 4, 5, 6 and 7. As depicted in FIG. 7, the grip has a solid cross section at the top end and a tapering hollow section as depicted in FIGS. 4, 5, 6 & 7. The cross sectional dimensions of the grip vary along length of the shaft as depicted in FIGS. 5, 6 & 7. The grip can be made out of rubber, neoprene, plastics or wood.

Figure 8:
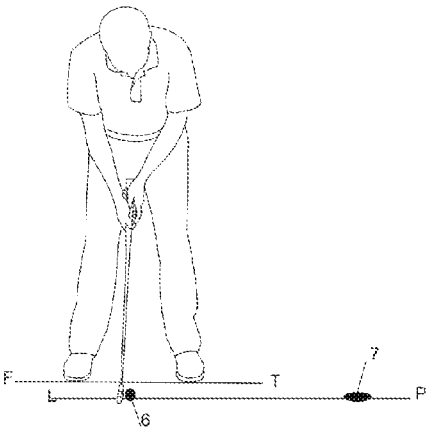
FIG. 8—depicts a player addressing the ball in a conventional way by holding the new putter with both the hands, according to an embodiment herein.

To execute the putting strike by employing the present putter, both the traditional method of putting with both hands, as well as the modern method of putting with single-hand can be used. The conventional method of putting with two hands using the present putter is depicted in FIG. 8. In FIG. 8, the golfer first assesses the alignment of the golf ball 6 and the target hole 7 in the putting surface until the two points 6, 7 appear to be in a straight line L-P. In the conventional stance, the line F-T passing adjacent to the toes of the golfer, and denoting the position of the golfer's feet, is parallel to the line of putt L-P. The golfer then targets the hole 7 along the line of putt L-P and strikes the golf ball 6.

By using the present putter, better results are obtained when single-hand putting method is used as the features of the present invention are designed to facilitate successful putting using the single-hand method.

Figure 9:
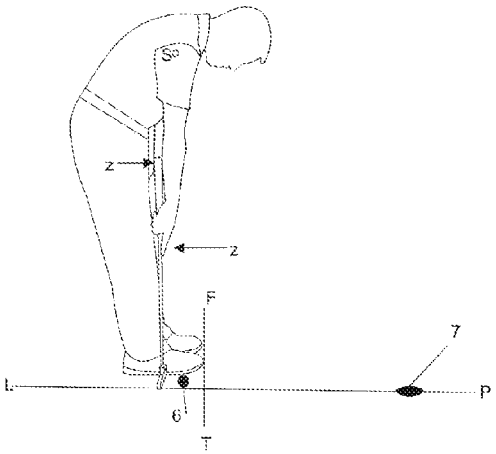
FIG. 9—depicts side view when a player is addressing the ball by holding the putter with one hand only, according to an embodiment herein.
Figure 10:
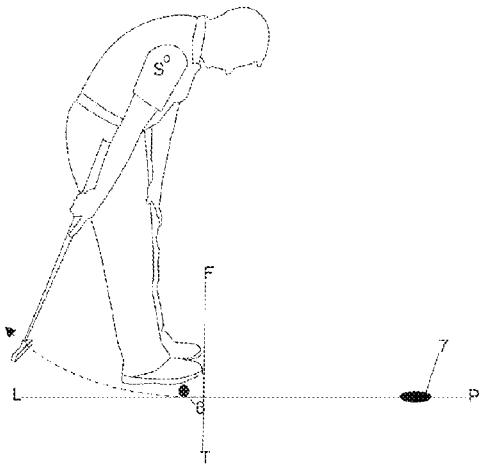
FIG. 10—depicts side view when a player has taken the back swing by holding the putter with one hand only, according to an embodiment herein.
Figure 11:
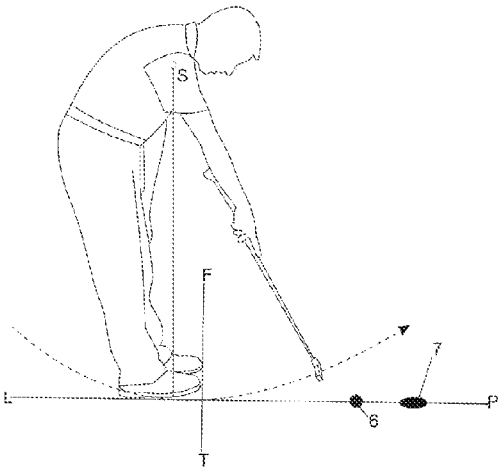
FIG. 11—depicts side view just after the putting stroke has been executed by holding the putter with one hand only, according to an embodiment herein.
Figure 12:
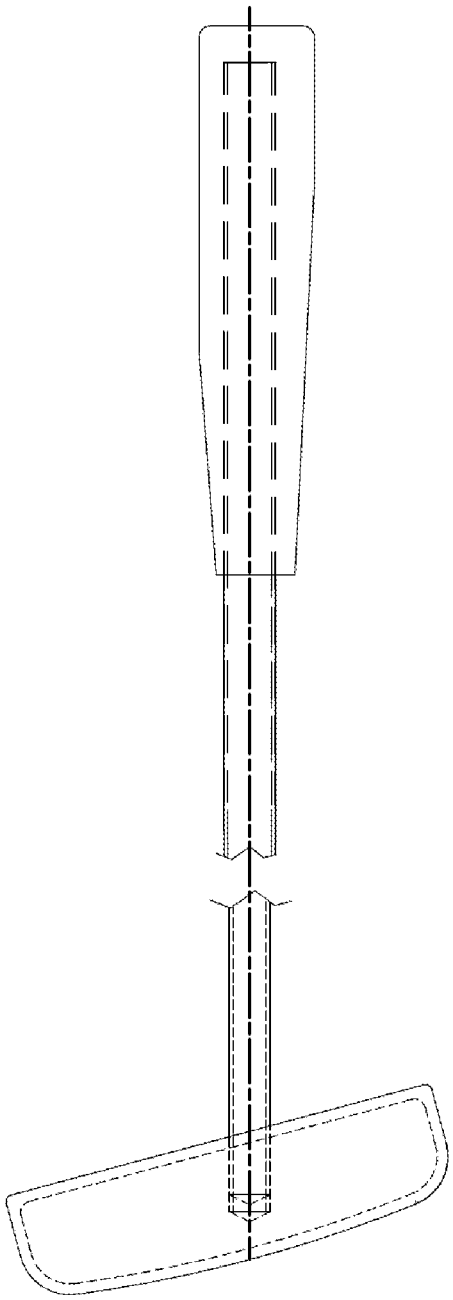
FIG. 12—depicts a putter wherein the connection between the shaft and head is direct i.e., without a neck piece, according to an embodiment herein.

FIGS. 9, 10 & 11 illustrates in detail single-hand putting method using the present putter.

FIG. 9 shows the stance taken by the golfer. During the stance, the golfer faces the target hole 7, with both feet on one side of the line of putt L-P. The line F-T passing adjacent to the golfer's toes, and denoting the golfer's feet position, is nearly perpendicular to the line of putt. The golfer holds the putter with one hand only, his fore finger is pressed against the shaft with a force "Z" and this in turn makes the top end of the flat portion of grip press against the arm of the golfer with the same amount of force "Z". These two forces help in holding the putter firmly without the aid of outside contraptions. This interlocking gripping ensures that the putter head does not twist when the ball is struck. This gripping also ensures that the wrist and the arm move together and there is no relative movement between them and therefore prevents uncontrollable nervous movements. In such a stance, the shoulder-ball joint of the player acts as a fulcrum and the putter effortlessly swings like a pendulum. The player can take a trial swing just above the ball, without striking the ball. The trial swing will establish whether the putter is swinging in a vertical plane and along the intended line of putt, thus ensuring that the ball can travel in the intended line. The player has to establish the line of putt as it depends on whether the putting surface is flat or sloping. The player has to take in to consideration other factors like cross wind, direction of grass blades, dry or wet conditions and other factors generally encountered in golf.

FIG. 10 shows the side view when the golfer takes the back swing, by swinging the putter in an arc backwards. The arm and the wrist of the golfer can swing together in a vertical plane positively. In such a movement, there is no bending of the wrist of the player. Since the grip on the putter locks the wrist, the errors of putting is greatly reduced as the muscles involved in the method of putting is very few and therefore, it does not require perfect co-ordination between the different parts like forearms, wrists, arms and the back (the spine being the axis) as required in the conventional methods.

FIG. 11 shows the status when the golfer is striking the ball with a forward pendulum swing. The ball travels towards the hole with correct speed and direction and can eventually drop in to the hole 7. In the forward swing, there is no bending of the wrist; and the swing is in a truly vertical plane. After striking the ball, the golfer should continue the swing to the give necessary "Follow Through". The "Follow Through" will ensure that the ball travels in the intended line of putt. The force with which the player strikes the ball is left to the player's judgment.

In conventional putting with conventional putters, there should be proper coordination between the two hands while putting. If the two hands cannot coordinate in a proper fashion, one hand dominating the other, the resultant strike can fail to putt. For a right-handed person, it is logical that his right hand can dominate over his left and vice-versa for a left-handed person. Therefore, proper co-ordination is obtained through controlled practices. One advantage with the new putter is that only one hand is used and therefore and there is no possibility of one hand dominating the other.

Fewer muscles of the player's body are involved in executing the putting stroke with the new putter as compared to conventional putters. The more the muscles involved, the more there is a possibility of non-coordination among them. Again, there is the issue of degrees of freedom. In the new type of putter, both these problems are efficiently addressed. The golfer has more degrees of freedom to putt with ease as well as the muscles involved are much less. Hence the chances of making errors during putting are reduced.

Another advantage of the present putter is that since the golfer is facing the hole the line of vision of the golfer is not contorted as seen in the conventional method. In the present putting method, it is easier to establish the line of putt accurately and in lesser time.

The swing is an essential way by which the golfer assesses the line of putt. The strike from the swing should result in a straight line, which is difficult to obtain in conventional methods of putting since the spine forms the axis of the swing and hence, the swing moves in a slight arc, rather than a straight line. One advantage of the new putter is that the pendulum swing can be achieved easily with it. The putter and the arm acts like one long pendulum with a fulcrum at the shoulder ball joint. Hence, there is no possibility of the swing moving in any other direction than the intended straight line. It can be seen clearly in FIGS. 10 & 11.

Since the method of putting, as explained above, gives the golfer excellent directional control, the method can be particularly advantageous in giving directional control needed for long putts.

The most important aspect of the present putter is that since there is no bending of the wrist involved, it can help the golfer to putt steadily at all times.

In one embodiment of the present putter, the length of the shaft is made to suit the height of the golfer. Taller the golfer, longer can be the grip.

In another embodiment the length of the grip is made to suit the golfer's arm length. Taller the golfer, longer the grip will be.

In an embodiment, the striking surface and the rear surface of the putter head are both flat.

In case of left-handed golfers, the present putter's mirror image along with the embodiments can be made to suit a left-handed golfer.

In an embodiment, the putter shaft is made to be highly flexible so that the ball can be hit with a whipping action.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

I claim:

1. A method of single-handed putting using golf putter, wherein said golf putter comprises:

a putter head having a top flat surface, a bottom portion and a flat striking face;

a shaft;

a grip comprises more than one flat surface including one flat surface end of the grip and an opposite flat surface end of the grip;

a neck piece connected between the putter head and the shaft;

wherein the top flat surface of the putter head forms an acute angle of not more than 75 degrees with the centerline of the shaft;

wherein a shaft diversion angle of the putter is at least 15 degrees; the method comprising the steps of:

holding the putter with only a single hand, wherein during address and swing of the putter, the player's shoulder joint, player's entire arm, flat surfaces of the grip, shaft, and neck piece are parallel in a same vertical plane, and bottom portion of the putter head is not parallel to the ground, particularly one end of bottom portion of the putter head resting on the ground and the rest of the portion of the bottom putter head not resting on the ground;

wherein holding the putter with only the single hand during address and swing, top end of the grip is above the wrist by a predetermined distance;

setting one flat surface end of the grip to touch the forearm of a player and exerting a force with the forefinger against the shaft by placing the forefinger on the opposite flat surface end of the grip to exert an equal amount of force on the top portion of the grip to achieve a locking grip;

wherein during address and swing of the putter, the flat striking face of the putter head is perpendicular to the intended line of putt; and wherein said putter operates as an extension of a player's arm to provide directional control at the time of putting stroke.

2. The method of single-handed putting using a golf putter as claimed in claim 1, wherein the putter head is not provided with any aiming device or lines.

3. A method of single-handed putting using a golf putter suitable for playing single handed putting, wherein said golf putter comprises:

a putter head having a bottom portion and a flat striking face;

a shaft;

a grip comprises more than one flat surface, including one flat surface end of the grip and an opposing flat surface end of the grip;

wherein the shaft is directly connected to the putter head with an acute angle of not more than 75 degrees to achieve shaft diversion angle of the putter at least 15 degrees; the method comprising the steps of:

holding the putter with only a single hand, wherein during address and swing of the putter, the player's shoulder joint, player's entire arm, flat surfaces of the grip, and shaft are parallel in a same vertical plane, and bottom portion of the putter head is not parallel to the ground, particularly one end of bottom portion of the putter head resting on the ground and rest portion of the bottom putter head not resting on the ground;

holding the putter with only a single hand, wherein top end of the grip is above the wrist by a predetermined distance;

setting one flat surface end of the grip to touch the forearm of a player and exerting a force with the forefinger against the shaft by placing the forefinger on the opposite flat surface end of the grip to exert an equal amount of force on the top portion of the grip to achieve a locking grip;

wherein during address and swing of the putter, the flat striking face of the putter head is perpendicular to the intended line of putt; and wherein said putter operates as an extension of a player's arm to provide directional control at the time of putting stroke.

4. The method of single-handed putting using a golf putter as claimed in claim 1, wherein the shaft is connected to the putter head by a bent neck piece, wherein the bent neck piece is parallel to the shaft.

5. The method of single-handed putting using a golf putter as claimed in claim 1, wherein the bottom curved surface of the putter head has a curved bottom with a radius of not less than 254 millimeters to prevent scraping of putting and also the ground to maintain skill level requirement for the player.

6. The method of single-handed putting using a golf putter as claimed in claim 1, wherein the putter head is flat and the rear face of the putter head has a depressed surface to reduce the weight of the putter head.

7. The method of single-handed putting using a golf putter as claimed in claim 1, wherein the shaft is made of rod of uniform cross-section with a hollow tapered, and connected to a tapering hallow section of the grip.

8. A method of single-handed putting using a golf putter as claimed in claim 1, wherein said method comprising the steps:

putting a ball with golf putter using a single hand of a player by holding a grip comprising more than a flat surface;

addressing and striking the ball by a shaft which is vertical or close to vertical to ground;

keeping the striking surface of the putter to face the target;

setting the center line of arm, and shaft in the same vertical plane;

setting the ball at near one end of the putter head;

taking trail swing just above the ball without striking the ball by the player;

setting one end of bottom portion of the putter head to touch the ground and rest portion of the putter head not to touch the ground while addressing the ball;

setting one flat surface end of the grip to touch the forearm of the player;

achieving a locking grip by exerting a force with the forefinger against the shaft by placing the forefinger on opposite flat surface end of the grip to exert an equal amount of force by the top portion of the grip against the arm without any external aid; and acting the shoulder joint as the fulcrum to facilitate the swing of the putter and to strike the ball.

* * * * *